US007217488B2

(12) United States Patent
Mikuriya et al.

(10) Patent No.: US 7,217,488 B2
(45) Date of Patent: May 15, 2007

(54) TONER COMPRISING CORE LAYER AND SHELL LAYER

(75) Inventors: Yoshihiro Mikuriya, Nishinomiya (JP); Tsuyoshi Nozaki, Ikeda (JP); Masayuki Hagi, Mino (JP); Atsushi Yamamoto, Kawanishi (JP); Yoshitaka Sekiguchi, Nishinomiya (JP); Chiyoshi Nozaki, Otsu (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 312 days.

(21) Appl. No.: 10/810,886

(22) Filed: Mar. 29, 2004

(65) Prior Publication Data

US 2005/0058927 A1 Mar. 17, 2005

(30) Foreign Application Priority Data

Sep. 17, 2003 (JP) ..... 2003-324440

(51) Int. Cl.
*G03G 9/093* (2006.01)

(52) U.S. Cl. ..... 430/110.2; 430/137.14

(58) Field of Classification Search ..... 430/110.2, 430/137.14, 108.1
See application file for complete search history.

(56) References Cited

U.S. PATENT DOCUMENTS

| | | | | |
|---|---|---|---|---|
| 5,567,567 | A | 10/1996 | Akiyama et al. | |
| 5,824,446 | A | 10/1998 | Nishihara et al. | |
| 6,541,173 | B1 * | 4/2003 | Kido et al. | 430/109.4 |
| 2002/0039699 | A1 * | 4/2002 | Nishimori et al. | 430/137.11 |
| 2004/0137357 | A1 * | 7/2004 | Bartel et al. | 430/137.14 |

FOREIGN PATENT DOCUMENTS

| | | |
|---|---|---|
| JP | 2002-229251 | 8/2002 |

* cited by examiner

*Primary Examiner*—John L Goodrow
(74) *Attorney, Agent, or Firm*—Buchanan Ingersoll & Rooney PC

(57) ABSTRACT

A toner comprising: a core layer and a shell layer formed on the core layer, wherein the core layer and the shell layer respectively comprise a first wax and a second wax; the second wax having a melting point that is higher than a melting point of the first wax;

the first wax having an average dispersion diameter that is smaller than the average dispersion diameter of the second wax; and the first wax having a content in the core layer that is greater than a content of the second wax in the shell layer.

17 Claims, No Drawings

TONER COMPRISING CORE LAYER AND SHELL LAYER

This application is based on application(s) No.2003-324440 filed in Japan, the contents of which are hereby incorporated by reference.

BACKGROUND OF THE INVENTION

1. Field of the Invention

The present invention relates to a toner, and more specifically concerns an electrostatic-latent-image developing toner used for developing an electrostatic latent image in electrophotography, electrostatic recording, electrostatic printing and the like.

2. Description of the Related Art

Conventionally, an electrostatic-latent-image developing toner, which is used for developing an electrostatic latent image in electrophotography, electrostatic recording, electrostatic printing and the like, has been produced by a so-called pulverizing method in which a pigment such as carbon black is mixed in a thermoplastic resin and melt-kneaded into a uniformly dispersed matter, and then pulverized by an appropriate finely-pulverizing device into powder having a particle size required as a toner. However, the toner obtained by the above-mentioned melt-kneading/pulverizing method has a limitation in controlling the toner particle size, and it is difficult to produce a toner having an average particle size of virtually not more than 8 μm, in particular, not more than 6 μm with high yield. In recent years, there have been ever-increasing demands for small-size copying machines and for low power consumption and the resulting demands for toner capable of carrying out a fixing process at a temperature lower than that of the conventional toner. For this reason, a method in which a wax having a low softening point is blended into the toner at the time of kneading has been proposed; however, in the kneading/pulverizing method, the blending rate is limited to approximately 5%, failing to provide a toner having a sufficient low-temperature fixing property.

In order to achieve a sufficient low-temperature-fixing property, not only a fixing property at a lower temperature, but also a fixing separation property and an anti-offsetting property need to be maintained even at the time of fixing without using oil coat, while maintaining appropriate anti-breaking and anti-blocking properties at the time of storing toner or developing toner. Here, methods have been proposed in which: a boner having a core-shell structure is granulated through a suspension polymerization method, an emulsion polymerizing coagulation method, an emulsion dispersion method and the like that are capable of providing resin fine particles having a small particle size with a comparatively uniform particle size, and the toner particles are allowed to contain a wax (for example, U.S. Patent Application Publication US2002/0039699 and Japanese Patent Application Laid-Open No. 2002-229251).

At present, however, even a toner having a core-shell structure has not sufficiently satisfied all the properties such as a property of low-fixing temperature, an anti-offsetting property, an anti-breaking property and an anti-blocking property.

SUMMARY OF THE INVENTION

The present invention is to provide a toner which can solve the above-mentioned problems, carry out a low-temperature fixing process, and provide superior low-fixing temperature property, anti-offsetting property, anti-breaking property and anti-blocking property.

The object of present invention can be achieved by a toner comprising: a core layer and a shell layer formed on the core layer, wherein the core layer and the shell layer respectively comprise a first wax and a second wax; the second wax having a melting point that is higher than a melting point of the first wax;

the first wax having an average dispersion diameter that is smaller than the average dispersion diameter of the second wax; and the first wax having a content in the core layer that is greater than a content of the second wax in the shell layer.

The content of the wax in a layer means a concentration of the wax in the layer.

The dispersion diameter means a particle size of wax dispersed granulatedly in resin.

DETAILED DESCRIPTION OF THE INVENTION

The present invention is characterized by a toner comprising:

a core layer and a shell layer formed on the core layer, wherein the core layer and the shell layer respectively comprise a first wax and a second wax; the second wax having a melting point that is higher than a melting point of the first wax;

the first wax having an average dispersion diameter that is smaller than the average dispersion diameter of the second wax; and the first wax having a content in the core layer that is greater than a content of the second wax in the shell layer.

In order to provide a low-temperature fixing property in the toner of the core-shell type, a method for introducing a low-melting-point wax into the core layer is proposed. In this method, however, the toner viscosity is seriously lowered, making it difficult to sufficiently ensure anti-offsetting property and anti-blocking property. In contrast, the toner of the present invention has a core layer and a shell layer with waxes being dispersed therein respectively, and the second wax in the shell layer is allowed to have a melting point higher than that of the first wax. Upon fixing, the first wax is fused to reduce the toner viscosity to allow a low-temperature fixing process, while the second wax in the shell layer is allowed to maintain a viscosity higher than that of the first wax, thereby maintaining an elastic property in the shell layer so that sufficient anti-offsetting property and fixing separation property are maintained. The presence of the second wax that imparts elasticity to the shell layer also maintain sufficient anti-breaking property and anti-blocking property. The average dispersion diameter of the first wax is made smaller than the average dispersion diameter of the second wax, with the content of the first wax in the core layer being greater than the content of the second wax in the shell layer; thus, in the core layer, the wax is uniformly dispersed with a high density so that it becomes possible to further reduce the viscosity of the toner. Here, in the shell layer, the dispersion diameter is made greater so that the eluting rate to the surface becomes greater so as to accelerate the separation property. Thus, it becomes possible to provide a low-temperature fixing property without causing degradation in toner properties such as the anti-offsetting property and the fixing separation property.

Here, in the present specification, the toner properties include properties, such as anti-offsetting property, fixing separation property, anti-breaking property and heat-resistant storing property (anti-blocking property), as well as image quality and cleaning property.

In the toner of the present invention, with respect to the first wax and the second wax, those having average-dispersion diameters respectively in ranges of 0.3 to 0.8 μm and 0.5 to 1.0 μm can be used. Those which have the content of the first wax in the core layer being set from 10 to 30% by weight and the content of the second wax in the shall layer being set from 5 to 25% by weight can be used.

In the toner of the present invention, the first wax and the second wax may be ester compounds, the first wax may contain a straight-chain saturated monohydroxy alcohol as an alcohol component, and the second wax may contain di- to hexa-valent polyhydroxy alcohol as an alcohol component.

In accordance with the present invention, it becomes possible to provide a toner that can carry out a low-temperature fixing process without causing degradation in toner properties such as the anti-offsetting property and the fixing separation property.

<Toner Structure and Manufacturing Method>

The toner of the present invention is constituted by a base resin layer (core layer) and a surface resin layer (shell layer). Here, the shell layer is prepared by allowing resin particles (resin particles (B)) constituting the shell layer to fusion-adhere to the surface of each of core particles that form the core layer. The core particles are prepared by allowing resin particles (resin particles (A)) and colorant particles to salting-out/fusion-adhere to each other.

In the present invention, "salting-out/fusion-adhering" processes refer to the fact that the salting-out (aggregation of fine particles) process and the fusion-adhering (elimination of interface between fine particles) process occur simultaneously or step by step, or the action that allows the salting-out process and the fusion-adhering process to take place simultaneously or step by step. With respect to these salting-out/fusion-adhering methods, for examples, manufacturing methods disclosed in the following patent documents may be used: Japanese Patent Application Laid-Open No. 2001-255700 (that discloses multi-stage aggregating processes using an aluminum-based coagulant), the above-mentioned U.S. Patent Application Publication US2002/0039699 (that discloses multi-stage aggregating processes using a magnesium chloride coagulant) and Japanese Patent Application Laid-Open No. 11-7156 (that discloses multi-stage aggregating processes using a combination of polyester particles/nonionic active agent).

In the present invention, "resin particles containing wax" can be obtained by a method for adding wax particles upon salting-out/fusion-adhering processes; however, it is more preferable to obtain these resin particles through a method in which composite resin fine particles, formed by dissolving a wax in at least a polymerizable monomer and subjecting the polymerizable monomer containing the wax to a polymerizing process, and colorant fine particles are subjected to salting-out/fusion adhering processes to each other. In the resin particles containing wax obtained through this method, it is possible to make the wax uniform in its state of existence, and also to eliminate the difference in the state of existence of wax between toner particles.

With respect to a preferable polymerization method for obtaining resin particles containing wax, the following method is proposed: a monomer solution, prepared by dissolving a wax in a polymerizable monomer, is dispersed in the form of oil droplets (10 to 1,000 nm) in an aqueous medium in which a surfactant is dissolved in a concentration of not more than the critical micelle forming concentration by applying mechanical energy to prepare a dispersion solution, and a water-soluble polymerization initiator is added to the dispersion solution thus obtained to allow a radical polymerization process to take place (hereinafter referred to as "miniemulsion method" in the present specification). Different from the normal emulsion polymerizing method, this miniemulsion method makes the wax dissolved in the polymerizable monomer less susceptible to separation so that a sufficient amount of the wax can be directed to the resin particles to be formed.

Here, in place of adding the water-soluble polymerization initiator, or together with the addition of the water-soluble polymerization initiator, an oil-soluble polymerization initiator may be added to the monomer solution.

As the dispersing machine to be used for carrying out the oil droplet dispersion by mechanical energy, not particularly limited, examples thereof include a mechanical-type dispersing machine "CLEARMIX" (made by M Technique) that is a stirring device having a high speed rotating rotor, an ultrasonic dispersing machine, a mechanical homogenizer, Manton-Gourin Homogenizer and a pressure homogenizer.

With respect to the wax, for example, various known waxes that are dispersed in water are listed. Specific examples of these waxes include olefin-based waxes such as low molecular weight polyethylene, low molecular weight polypropylene, copolymer polyethylene, grafted polyethylene and grafted polypropylene; ester-based waxes having a long-chain aliphatic group such as behenyl behenate, montanic acid ester and stearyl stearate; plant-based waxes such as hydrogenated castor oil and carnauba wax; ketones having a long-chain alkyl group such as distearyl ketone; silicone-based waxes having an alkyl group or a phenyl group; higher fatty acid such as stearic acid; higher fatty acid amides such as oleic acid amide and stearic acid amide; long-chain fatty acid alcohols; long-chain fatty acid polyhydroxy alcohols such as pentaerythritol, and partial esters thereof; paraffin-based waxes; and Fischer-Tropsch wax.

With respect to preferable waxes for the toner of the present invention, those composed of a crystalline ester compound represented by the following formula (1) (hereinafter, referred to as "specific ester compound") can be proposed.

$$R_1—(OCO—R_2)_n$$

(in the formula, each of $R_1$ and $R_2$ represents a hydrocarbon group having 1 to 40 carbon atoms, which may have a substituent, and n is an integer of 1 to 4.)

In formula (1) representing the specific ester compound, each of $R_1$ and $R_2$ represents a hydrocarbon group that may have a substituent. The hydrocarbon group $R_1$ has 1 to 40 carbon atoms, preferably 1 to 20, more preferably 2 to 5. The hydrocarbon group $R_2$ has 1 to 40 carbon atoms, preferably 16 to 30, more preferably 18 to 26. In formula (1), n is an integer of 1 to 4, preferably 2 to 4, more preferably 3 and 4, most preferably 4. The specific ester compound is preferably synthesized through a dehydration condensing reaction between alcohol and carboxylic acid.

With respect to the carboxylic acid constituting the specific ester compound, straight-chain saturated monocarboxylic acid, selected from those having 14 to 30 carbon atoms with one of the components accounting for not less than 60% by weight, can be used, and with respect to the alcohol, straight-chain saturated monohydroxy alcohol selected from those having 14 to 30 carbon atoms with one of the components accounting for not less than 60% by weight or di- to hexa-hydroxy polyhodroxy alcohol selected from those having 2 to 30 carbon atoms with one of the components accounting for not less than 80% by weight, can be used.

With respect to the above-mentioned straight-chain saturated monocarboxylic acid, examples thereof include myristic acid, palmitic acid, stearic acid, arachic acid, behenic acid, lignoceric acid, cerotic acid, montanic acid and melissic acid.

With respect to the above-mentioned straight-chain saturated monohydroxy alcohol, examples thereof include myristyl alcohol, cetyl alcohol, stearyl alcohol, arachyl alcohol, behenyl alcohol, tetracosanol, hexacosanol, octacosanol and triacontanol.

Among di- to hexa-valent polyhydroxy alcohols, examples of di-hydroxy alcohols include: ethylene glycol, propylene glycol, 1,3-propane diol, 1,4-propane diol, 1,5-pentane diol, 1,6-hexane diol, 1,10-decane diol, 1,12-dodecane diol, 1,14-tetradecane diol, 1,16-hexadecane diol, 1,18-octadecane diol, 1,20-eicosane diol, 1,30-triacontane diol, diethylene glycol, dipropylene glycol, 2,2,4-trimethyl-1,3-pentane diol, neopentyl glycol, 1,4-cyclohexane dimethanol, spiroglycol, 1,4-phenylene glycol, bisphenol A and hydrogenated bisphenol A. With respect to trihydroxy alcohols, examples thereof include: 1,2,4-butane triol, 1,2,5-pentane triol, 2-methyl-1,2,4-butane triol, glycerin, 2-methyl propane triol, trimethylol ethane, triethylol ethane, trimethylol propane and 1,3,5-trihydroxy methyl benzene. With respect to tetrahydroxy alcohols, examples thereof include: 1,2,3,6-hexane tetraol and pentaerythritol, examples of pentahydroxy alcohols include glucose and the like, and examples of hexahydroxy alcohols include dipentaerythritol and the like.

With respect to specific examples of the specific ester compound, those compounds exemplified by formulas 1) to 22) in U.S. Patent Application Publication US2002/0039699 can be used.

In the present invention, the melting point of the second wax contained in the shell layer needs to be higher than the melting point of the first wax contained in the core layer, and the difference between the melting points is preferably not less than 5° C., more preferably not less than 10° C. Here, both of the first and second waxes are preferably prepared as waxes having a melting point of not more than 100° C., and the melting point of the wax is more preferably set in a range of 40 to 100° C., most preferably in a range of 60 to 90° C. This is because the melting point exceeding 100° C. causes degradation in the effects of its fixing temperature reduction.

Here, the average dispersion diameter of the first wax is preferably made smaller than the average dispersion diameter of the second wax, and the content of the first wax in the core layer is preferably made greater than the content of the second wax in the shell layer. Preferably, the average dispersion diameters of the first wax and the second wax are respectively set to 0.3 to 0.8 μm and 0.5 to 1.0 μm.

The content of the first wax in the core layer is from 10 to 30% by weight, preferably from 10 to 25% by weight, more preferably from 10 to 20% by weight. When the content is smaller than 10% by weight, the effects of the viscosity reduction in the toner are not exerted sufficiently, and when it exceeds 30% by weight, the viscosity reduction in the toner becomes too great, resulting in degradation in the anti-offsetting property and the separation property.

The content of the second wax in the shell layer is from 5 to 25% by weight, preferably from 5 to 20% by weight, more preferably from 5 to 15% by weight. When the content is smaller than 5% by weight, the dispersion diameter of the wax becomes too small, making the eluting rate smaller to cause degradation in the separation property, and when the content exceeds 25% by weight, the eluting rate becomes too great, resulting in degradation in the heat resistant storing property as well as generation of filming.

The first wax and the second wax are ester compounds, and preferably, the first wax contains the above-mentioned straight-chain monohydroxy alcohol as an alcohol component and the second wax contains the above-mentioned di- to hexa-valent polyhydroxy alcohol as an alcohol component. The application of the wax having the straight-chain monohydroxy alcohol as its constituent component to the first wax improves the compatibility to a styrene-based resin generally used as a resin component as the core layer so that the wax is uniformly dispersed in the core layer.

The following description will discuss the resin particles A forming the core layer and the resin particles B forming the shell layer.

<Outline of Resin Particles A>

With respect to the resin particles A forming the core layer, not particularly limited as long as they are resin particles that are stably dispersed in an aqueous system, known resin composition systems/manufacturing methods can be used. In particular, from the viewpoint of the fixing property and shelf life of the toner, a styrene acryl-based copolymer resin or a polyester-based resin is preferably used among the following radical polymerizable resins. In the case when a low-molecular-weight component, a high-molecular-weight component and an intermediate-molecular-weight component are used in a composite form, radical polymerizable resin particles, obtained by using multi-stage polymerization processes through an emulsion polymerization method, are preferably used from the viewpoint of proper manufacturing properties. The weight-average particle size of the resin particles A is preferably set in a range of 50 to 500 nm. With respect to the particle sizes of these resin particles, the above-mentioned wax and a colorant dispersion matter, which will be described later, can be measured by using a dynamic light-scattering size distribution meter: Microtrack UPA150 (made by Honeywell International Inc.) and the like. (Molecular weight of resin particles A)

The weight-average molecular weight Mw (A) of the resin particles A is normally from 15,000 to 500,000, preferably from 20,000 to 200,000, more preferably from 25,000 to 150,000.

The resin particles A may be formed by a plurality of kinds of resin particles having different molecular weights (for example, high-molecular-weight resin particles, intermediate-molecular-weight resin particles and low-molecular-weight resin particles), or may be formed by resin particles (composite resin particles) each of which has multi-layered (composite) resins that have different molecular weights through a multi-stage polymerization method. In other words, the core particles may be obtained by allowing a plurality of kinds of resin particles having different molecular weights and colorant particles to salt-out/fusion-adhere to one another, or may be formed by allowing composite resin particles and colorant particles to salt-out/fusion-adhere to one another.

The weight-average molecular weight of high-molecular-weight resin particles (high-molecular weight component of the composite resin particles) forming the resin particles A is preferably from 160,000 to 500,000. By using the resin particles A constituted by these high-molecular-weight resin particles (high-molecular-weight component), it becomes possible to impart sufficient anti-offsetting property (internal aggregating force at high temperatures) to the resulting toner.

The weight-average molecular weight of low-molecular-weight resin particles (low-molecular weight component of the composite resin particles) forming the resin particles A is preferably from 15,000 to 20,000. By using the resin particles A constituted by these low-molecular-weight resin particles (low-molecular-weight component), it becomes possible to impart superior fixing property (adhesive force to an image-forming support member) to the resulting toner.

The weight-average molecular weight of intermediate-molecular-weight resin particles (intermediate-molecular weight component of the composite resin particles) forming the resin particles A is preferably from 20,001 to 159,999.

The above-mentioned high-molecular-weight resin, low-molecular-weight resin and intermediate-molecular-weight resin are appropriately blended to form the resin particles A.

Here, the glass transition temperature of the resin particles A is set in a range from 0 to 80° C., preferably from 30 to 70° C. The transition temperature higher than this range makes the fixing temperature higher, and causes degradation in the OHP light transmission property. In contrast, the transition temperature lower than this range causes degradation in the anti-blocking property and shelf life of the toner.

<Outline of Resin Particles B>

With respect to the resin particles B forming the shell layer, not particularly limited as long as they are resin particles that are stably dispersed in an aqueous system, known resin composition systems/manufacturing methods can be used. In particular, from the viewpoint of the fusion-adhering and film-forming properties of the shell layer, a required low-molecular-weight resin (b1) is preferably formed by a styrene acryl-based copolymer resin or a polyester-based resin having a comparatively low molecular weight, and from the viewpoint of the strength of the shell layer, a required high-molecular-weight resin (b2) is preferably formed by a styrene acryl-based copolymer resin or a polyester-based resin having a comparatively high molecular weight. In particular, with respect a resin composition system having superior mechanical strength, resins in which a polyester resin and a polyester prepolymers are expanded by using urethane are preferably used, and in order to further increase the strength, these may have a cross-linking structure.

With respect to the above-mentioned b1 component and b2 component, appropriate material systems may be properly selected depending on developing systems and fixing systems. For example, a combination of a styrene acrylic resin serving as the b1 component and a polyester resin serving as the b2 component or a reversed combination thereof may be used, and another functional material having effects on the chargeability and fixing property may be selected as the shell layer. Here, the same material system is preferably used as the resin particles A and the b1 component of the resin particles B in order to improve the fusion-adhering property and the film-forming property thereof.

With respect to the means for obtaining the resin particles B, for example, in the case when the styrene acrylic resin is used, an emulsion polymerization method and a suspension polymerization method are preferably used. In the case when the polyester resin particles are used, the resin particles B are easily obtained through a method in which a polymer preliminarily prepared is dissolved in a solvent to be suspended and emulsion-dispersed in the aqueous system, and this is subjected to a de-solvent process. In particular, in the case when the above-mentioned b1 component and the b2 component are used in a composite form, composite particles each of which has the b2 component coated with the b1 component are preferably used. In this case, particles each of which has the high-molecular-weight styrene acrylic resin coated with the low-molecular-weight styrene acrylic resin through the multi-stage polymerization processes through the emulsion polymerization method or particles, which are formed by seed-polymerizing a styrene acrylic resin with a high-molecular-weight polyester resin preliminarily obtained through an emulsion-dispersing process in an aqueous system, are preferably used.

Here, the weight-average particle size of the resin particles B is preferably set in a range from 50 to 500 nm.

(Molecular Weight of Resin Particles B)

The weight-average molecular weight Mw(B) of the resin particles B is preferably set in a range that satisfies the following expression with respect to the weight-average molecular weight Mw(A) of the resin particles A:

$$Mw(A)<Mw(B)$$

The weight-average molecular weight of the resin particles B is preferably from 30,000 to 200,000.

Preferably, the above-mentioned b1 component has a molecular weight that is smaller than the weight-average molecular weight Mw(A) of the resin particles A, and the above-mentioned b2 component has a molecular weight that is greater than the Mw(A). Thus, the b1 component makes it possible to improve the fusion-adhering property and film-forming property, and consequently to smooth the surface shape of the resulting toner particles. The b2 component enhances the mechanical strength of the shell layer. The b1 component and b2 component are contained so that the hardness of the shell layer is increased and the interface inside the shell layer is eliminated; thus, the toner surface is smoothed. Thus, it becomes possible to greatly improve the anti-stress property of the toner.

In order to allow the b1 component to exert sufficient fusion-adhering property and film-forming property, the weight-average molecular weight Mw(b1) is made smaller than Mw(A), and preferably set in a range of 5,000 to 20,000. The glass transition temperature Tg of the b1 component is from 40 to 80° C., preferably from 50 to 70° C. The rate of the b1 component in the entire resin component of the resin particles B is from 5 to 50% by weight, preferably from 10 to 40% by weight.

In order to form a tough shell layer, the weight-average molecular weight Mw(b2) of the b2 component is made greater than Mw(A), and preferably set in a range of 4,000 to 300,000. The glass transition temperature of the b2 component is set in a range from 40 to 80° C., preferably from 50 to 70° C. The rate of the b2 component in the entire resin component of the resin particles B is set in a range from 50 to 95% by weight, preferablly from 60 to 90% by weight.

In order to improve the anti-stress property, it is preferable to satisfy a relationship indicated by the following expression:

$$Mw(b1)<Mw(A)<Mw(b2)$$

Thus, with respect to the shell layer as a whole, it becomes possible to increase the hardness, to eliminate the interface inside the shall layer and also to smooth the toner surface.

With respect to the b1 component and the b2 component, these may be prepared as different particles, or may be form as resin particles (composite resin particles) that are formed into multi-layers (composite form) through a multi-stage polymerization method or the like so as to satisfy preferable molecular-weight ranges of the b1 component and b2 component. In this case, the b2 component is preferably coated (capsulated) with the b1 component. Thus, it becomes possible to make the shell layer uniform and also to further improve the film-forming property thereof.

The shell layer is prepared by allowing a plurality of kinds of resin particles that have different molecular weights and contain the b1 component and the b2 component to salt-out/fusion-adhere to one another, or by allowing composite resin particles to salt-out/fusion-adhere to one another.

(Blending Ratio of Resin Particles A and Resin Particles B)

The blending ratio of the resin particles A and the resin particles B, that is, the weight ratio of core layer: shell layer is preferably from 70:30 to 95:5. When the weight ratio of the shell layer is lower than 5%, the effects of the shell layer for improving the mechanical strength of the toner are no longer exerted, and when the weight ratio of the shell layer becomes higher than 30%, the fixing temperature becomes too high.

(Measuring Methods for Molecular Weight)

The weight-average molecular weight of the resin particles A [including respective weight-average molecular weights of a plurality of kinds of resin particles having different molecular weights and the entire weight-average molecular weight Mw(A)] and the weight-average molecular weight of the resin particles B [including respective weight-average molecular weights Mw(b1) and Mw(b2) of a plurality of kinds of resin particles having different molecular weights and the entire weight-average molecular weight Mw(B)] are molecular weights measured by using a GPC (gel permeation chromatography) based upon styrene conversion.

With respect to the measuring method of the molecular weight of resin by using a GPC, 1 cc of THF is added to 0.5 to 5.0 mg (more specifically, 1 mg) of a test sample, and this is stirred at room temperature by using a magnetic stirrer or the like to be sufficiently dissolved therein.

Next, after having been treated with a membrane filter having a pore size of 0.45 to 0.50 μm, this is injected into the GPC. With respect to the measuring conditions of the GPC, the column was stabilized at 40° C., and about 10 μl of the sample having a concentration of 1 mg/cc is injected while THF is allowed to flow at a flow rate of 0.35 cc per minute; thus, measurements are carried out. With respect to the column, commercial polystyrene gel columns are preferably used in combination. Specific examples thereof include TSKgel Super HZ1000, HZ2000, HZ2500, HZ3000, HZ4000, HZM-N, HZM-M, HZM-H, TSKguardcolumn SuperHz-L and HZ-H that are used in combination.

With respect to the detector, a refractive-index detector (RI detector) or an UV detector may be preferably used. With respect to the molecular-weight measurements of the sample, the molecular-weight distribution of the sample is calculated by using a calibration curve measured by the use of single-dispersion polystyrene standard particles. With respect to calibration-curve measuring polystyrene, about ten points thereof are used.

<Measuring Method of Glass Transition Temperature (Tg)>

A differential scanning calorimeter (DSC-200: made by Seiko Instruments Inc.) was used in which: 10 mg of a sample to be measured was precisely weighed, and this was put into an aluminum pan, with alumina being put into an aluminum pan so as to be used as reference, and was heated to 200° C. from normal temperature at a temperature-rise rate of 30° C./min, and this was then cooled, and subjected to measurements in the range of 20° C. to 150° C. at a temperature-rise rate of 10° C./min; thus, during this temperature-rise process, a shoulder value of the main heat-absorbing peak in the range of 30° C. to 90° C. was obtained as Tg.

<Examples of Materials Forming Resins A and B and Manufacturing Examples Thereof>

The following description will specifically describe examples of materials forming resin particles A and resin particles B and manufacturing examples thereof; however, the present invention is not intended to be limited by these.

Radical-polymerization-based resins and polyester-based resins may be used as resin particles.

With respect to a polymerizable monomer to be used for obtaining the radical-polymerization-based resin, a radical polymerizable monomer is used as an essential constituent component with a cross-linking agent being added thereto, if necessary. At least one kind of the following radical polymerizable monomers having an acidic group or radical polymerizable monomers having a basic group is preferably added thereto.

(Radical-polymerization-based resin)

(1) Radical Polymerizable Monomer

With respect to the radical polymerizable monomer, not particularly limited, radical polymerizable monomers known in the art may be used. One kind or more kinds thereof may be used in combination so as to satisfy required properties.

More specifically, monomers, such as an aromatic-based vinyl monomer, a (metha)acrylic acid ester-based monomer, a vinyl ester-based monomer, a vinyl ether-based monomer, a monoolefin-based monomer, a diolefin-based monomer and a halogenated olefin-based monomer, may be used.

With respect to the vinyl aromatic monomers, examples thereof include: styrene-based monomers and derivatives thereof, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

With respect to the (metha)acrylic acid ester monomers, examples thereof include: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, propyl γ-amino acrylate, stearyl methacrylate, dimethylaminoethyl methacrylate and diethylaminoethyl methacrylate.

With respect to the vinyl ester monomer, examples thereof include vinyl acetate, vinyl propionate and vinyl benzoate. With respect to the vinyl ether monomer, examples thereof include vinyl methyl ether, vinyl ethyl ether, vinyl isobutyl ether and vinyl phenyl ether. With respect to the monoolefin monomer, examples thereof include ethylene, propylene, isobutylene, 1-butene, 1-pentene and 4-methyl-1-pentene. With respect to the diolefin monomer, examples thereof include butadiene, isoprene and chloroprene. With respect to the halogenated olefin monomer, examples thereof include vinyl chloride, vinylidene chloride and vinyl bromide.

(2) Crosslinking Agent

In order to improve the properties of the toner, a radical polymerizable crosslinking agent may be added thereto.

With respect to the radical polymerizable crosslinking agent, examples thereof include those monomers having two or more unsaturated bonds, such as divinyl benzene, divinyl naphthalene, divinyl ether, diethylene glycol methacrylate, ethylene glycol dimethacrylate, polyethylene glycol dimethacrylate and diallyl phthalate.

(3) Radical Polymerizable Monomer Having an Acidic Group or a Basic Group

With respect to the radical polymerizable monomer having an acidic group or the radical polymerizable monomer having a basic group, for example, amine-based compounds, such as a carboxyl-group-containing monomer, a sulfonic-acid-group-containing monomer, primary amine, secondary amine, tertiary amine and quaternary ammonium salt, may be used.

With respect to the radical polymerizable monomer having an acidic group, examples thereof include carboxylic-acid-group-containing monomers such as acrylic acid, methacrylic acid, fumaric acid, maleic acid, itaconic acid, cinnamic acid, monobutyl maleate and monooctyl maleate. Examples thereof also include sulfonic-acid-group-containing monomers, such as styrene sulfonate, allyl sulfosuccinate and octyl allyl sulfosuccinate.

These may form an alkali metal salt such as sodium and potassium or an alkali earth metal salt such as calcium.

With respect to the radical polymerizable monomer having a basic group, examples thereof include amine-based compounds, such as dimethylaminoethyl acrylate, dimethylaminoethyl methacrylate, diethylaminoethyl acrylate, diethylaminoethyl methacrylate, and quaternary ammonium salts of the above-mentioned four compounds, 3-dimethylaminophenyl acrylate, 2-hydroxy-3-methacryloxy propyltrimethyl ammonium salt, acryl amide, N-butyl acrylamide, N,N-dibutyl acrylamide, piperidyl acrylamide, methacryl amide, N-butyl methacrylamide, N-octadecyl acrylamide; vinyl pyridine, vinyl pyrrolidone; vinyl N-methylpyridinium chloride, vinyl N-ethylpyridinium chloride, N,N-diallylmethylammonium chloride and N,N-diallylethyl ammonium chloride.

With respect to the radical polymerizable monomer to be used in the present invention, the radical polymerizable monomer having an acidic group or the radical polymerizable monomer having a basic group is preferably used at a rate of 0.1 to 15% by mass with respect to the entire monomer, and although it depends on the characteristics thereof, the used amount of the radical polymerizable crosslinking agent is preferably set in a range of 0.1 to 10% by mass with respect to the entire radical polymerizable monomer.

(Chain Transfer Agent)

In order to adjust the molecular weight of the resin particles, a generally-used chain transfer agent may be adopted. Although not particularly limited, examples of the chain transfer agent include: mercaptans such as octyl mercaptan, dodecyl mercaptan and tert-dodecyl mercaptan, n-octyl-3-mercaptopropionic acid ester, terpinolene, carbon tetrabromide, and α-methylstyrene dimer.

(Polymerization Initiator)

With respect to the radical polymerization initiator, any of those conventional initiators may be used as long as it is water-soluble. Examples thereof include persulfates (such as potassium persulfate and ammonium persulfate), azo-based compounds (such as 4,4'-azobis 4-cyano valerate and its salt, and 2,2'-azobis(2-amidinopropane)salt) and peroxide compounds.

The above-mentioned radical polymerization initiator may be combined with a reducing agent, if necessary, and prepared as a redox initiator. By using the redox initiator, the polymerization activity is enhanced so that the polymerization temperature is lowered and the polymerization time can be shortened.

The polymerization temperature is set to any temperature as long as it is not less than the lowest radical generation temperature of the polymerization initiator; and, for example, it is set in a range of 50° C. to 90° C. Here, by using a normal-temperature starting polymerization initiator, for example, a combination of hydrogen peroxide-reducing agent (ascorbic acid or the like), the polymerization can be carried out at room temperature or a temperature of not less than room temperature.

(Surfactant)

In order to carry out a polymerizing process by using the above-mentioned radical polymerizable monomer, it is necessary to disperse oil droplets in an aqueous solvent by using a surfactant. With respect to the surfactant to be used in this process, for example, although not particularly limited thereto, the following ionic surfactants are proposed as preferable compounds.

With respect to ionic surfactants, examples thereof include sulfonates (such as sodium dodecylbenzene sulfonate, sodium arylalkylpolyether sulfonate, sodium 3,3-disulfonediphenyl urea-4,4-diazo-bis-amino-8-naphthol-6-sulfonate, ortho-carboxybenzene-azo-dimethyl aniline and 2,2,5,5-tetramethyl-triphenyl methane-4,4-diazo-bis-β-naphthol-6-sulfonate), sulfates (such as sodium dodecyl sulfate, sodium tetradecyl sulfate, sodium pentadecyl sulfate and sodium octyl sulfate), and fatty acid salts (such as sodium oleate, sodium laurate, sodium caprinate, sodium caprylate, sodium capronate, potassium stearate and calcium oleate).

Nonionic surfactants may also be used. Specific examples thereof include polyethylene oxide, polypropylene oxide, a combination of polypropylene oxide and polyethylene oxide, an ester of polyethylene glycol and higher fatty acid, alkyl phenol polyethylene oxide, an ester of higher fatty acid and polyethylene glycol, an ester of higher fatty acid and polypropylene oxide and a sorbitan ester.

(Polyester Resin)

With respect to the polyester-based resin, a polyester resin, prepared by condensation-polymerizing a polyhydroxy alcohol component and a polycarboxylic acid component, can be applied.

Among polyhydroxy alcohol components, examples of dihydroxy alcohol components include: bisphenol A alkylene oxide adducts, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol A and hydrogenated bisphenol A.

Examples of trihydroxy or higher alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dihydroxy carboxylic acid components include: maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides or lower alkyl esters of these acids.

Examples of trihydroxy or higher carboxylic acid components include: 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides or low alkyl esters of these acids.

In the present invention, additives such as colorants shown below may be added thereto.

(Colorant)

With respect to the colorants constituting the toner of the present invention, various kinds of inorganic pigments, organic pigments and dyes are listed.

With respect to the inorganic pigments, conventionally known pigments may be used. Specific examples of the inorganic pigments are shown below: With respect to the black pigments, examples thereof include: carbon blacks such as Furnace Black, Channel Black, Acetylene Black, Thermal Black and Lamp Black, as well as magnetic powder such as magnetite and ferrite. These inorganic pigments may be used alone or a plurality of these may be used in combination, on demand. The added amount of the pigments is preferably set in a range of 2 to 20% by mass, preferably 3 to 15% by mass, with respect to the copolymer.

When used as the magnetic toner, the above-mentioned magnetite may be added thereto. In this case, from the viewpoint of imparting predetermined magnetic characteristics, the added amount in the toner is preferably set in a range of 20 to 60% by mass.

With respect to the organic pigments and dyes, conventionally known pigments and dyes may be used. Specific examples of the organic pigments and dyes are shown below:

With respect to magenta or red pigments, examples thereof include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

With respect to orange or yellow pigments, examples thereof include: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155 and C.I. Pigment Yellow 156.

With respect to green or cyan pigments, examples thereof include: C.I. Pigment Blue 15, C.I. Pigment Blue 15:2, C.I. Pigment Blue 15:3, C.I. Pigment Blue 16, C.I. Pigment Blue 60 and C.I. Pigment Green 7.

With respect to dyes, examples thereof include: C.I. Solvent Reds 1, 49, 52, 58, 63, 111 and 122; C.I. Solvent Yellows 19, 44, 77, 79, 81, 82, 93, 98, 103, 104, 112 and 162; and C.I. Solvent Blues 25, 36, 60, 70, 93 and 95. A mixture of these may be used.

These organic pigments and dyes may be used alone or a plurality of these may be used in combination, on demand. The added amount of the pigments is preferably set in a range from 2 to 20% by weight, preferably from 3 to 15% by weight, with respect to the polymer.

The colorant may be subjected to a surface-modifying treatment, and used. With respect to the surface-modifying agent, those of conventionally known agents may be used, and more specifically, silane coupling agents, titanium coupling agents, aluminum coupling agents and the like may be preferably used.

(External Additive Agents)

In the present invention, in an attempt to improve the fluidizing property, chargeablity and cleaning property of the colored particles obtained through the above-mentioned salting-out/fusion-adhering processes, so-called externally additive agents may be added thereto. With respect to these externally additive agents, not particularly limited, various inorganic particles, organic fine particles and lubricating agents may be used.

With respect to the inorganic fine particles, those of conventionally known particles may be used. Specifically, silica, titanium and alumina fine particles may be preferably used. These inorganic fine particles preferably have a hydrophobic property. Specific examples of silica fine particles include: commercial products, R-805, R-976, R-974, R-972, R-812 and R-809, made by Nippon Aerosil Co., Ltd.; HVK-2150 and H-200, made by Hoechst Limited.; and commercial products, TS-720, TS-530, TS-610, H-5 and MS-5, made by Cabot Co. Specific examples of titanium fine particles include: commercial products, T-805 and T-604, made by Nippon Aerosil Co., Ltd.; commercial products, MT-100S, MT-100B, MT-500BS, MT-600, MT-600SS and JA-1, made by TAYCA CORPORATION; commercial products, TA-300SI, TA-500, TAF-130, TAF-510, TAF-510T, made by Fuji Titanium Industry Co., Ltd.; and commercial products, IT-S, IT-OA, IT-OB, IT-OC and the like, made by Idemitsu Kosan Co., Ltd. With respect to the alumina fine particles, examples thereof include: commercial products RFY-C and C-604, made by Nippon Aerosil Co., Ltd., and commercial products, TTO-55 made by Ishihara Sangyo Kaisha, Ltd.

Spherical organic fine particles having a number-average primary particle size of 10 to 2000 nm may be used as the organic fine particles. With respect to these fine particles, styrene and methyl methacrylate may be used as single polymers respectively, or a copolymer of these may be used.

With respect to the lubricating agent, examples thereof include: metal salts of higher fatty acid, such as salts of stearic acid of zinc, aluminum, copper, magnesium, calcium and the like, salts of oleic acid of zinc, manganese, iron, copper, magnesium and the like, salts of palmitic acid of zinc, copper, magnesium, calcium and the like; and salts of recinoleic acid of zinc, calcium and the like.

The toner of the present invention can be manufactured by using, for example, the following method. In other words, basically, the manufacturing methods has processes of: preparing resin particles A that form a core layer and contain a first wax and resin particles B that form a shell layer and contain a second wax; forming core particles (colored particles) by salting-out/fusion-adhering the resin particles A to colorant particles; and manufacturing toner particles having a core-shell structure by salting-out/fusion-adhering the colorant particles to the resin particles B.

More specifically, each of the processes for preparing the resin particles A and the resin particles B is provided with a dissolving process which dissolves a wax in a polymerizable monomer to prepare a monomer solution, a dispersing process which disperses the resulting monomer solution in an aqueous medium, and a polymerizing process which carries out a polymerization process on the aqueous dispersion system of the resulting monomer solution so that a dispersion solution (latex) of resin particles containing the wax.

The manufacturing method is also provided with: a first salting-out/fusion-adhering process in which the resin particles A and the colorant particles are subjected to salting-out/fusion-adhering processes in the aqueous medium so that core particles are obtained; a second salting-out/fusion-adhering process in which the colorant particles and the resin particles B are subjected to salting-out/fusion-adhering processes to form a shell layer so that toner particles are obtained; filtering/washing processes which filter and separate the resulting toner particles from the aqueous medium, and wash and remove the surfactant and the like from the toner particles; and a drying process for the toner particles that have been washed, and, if necessary, an external additive agent applying process for adding an external additive agent to the toner particles that have been dried is further added thereto.

(1) Dissolving Process

Not particularly limited, any method for dissolving a wax in a polymerizable monomer may be used. An oil-soluble polymerization initiator and another oil-soluble component may be added to this monomer solution.

(2) Dispersion Process

With respect to a method for dispersing the monomer solution into the aqueous medium, not particularly limited, a method for dispersing the solution by using mechanical energy is preferably used, and, in particular, a method in which a monomer solution is dispersed in a form of oil drops in an aqueous medium in which a surfactant is dissolved in a concentration of not more than the critical micelle forming concentration by applying mechanical energy (essential mode in "mini-emulsion method") is preferably used.

Here, as the dispersing machine to be used for carrying out the oil drop dispersion through mechanical energy, although not particularly limited, for example, a stirring apparatus "Clearmix", an ultrasonic dispersing machine, a mechanical homogenizer, a Manton-Gourin Homogenizer and a pressure homogenizer are proposed. The particle size of the dispersed particles is usually from 10 to 1,000 nm, preferably from 30 to 300 nm.

(3) Polymerization Process

In the polymerization process, basically, any of conventionally known polymerization methods (an emulsion polymerization method, a suspension polymerization method, a granulation polymerization method such as a seed polymerization method) may be used. One example of preferable polymerization methods is a mini-emulsion method in which: a monomer solution is dispersed in a form of oil drops in an aqueous medium prepared by dissolving a surfactant in a concentration of not more than the critical micelle forming concentration by applying mechanical energy so that a dispersion solution is obtained, and a water soluble polymerization initiator is added thereto to start a radical polymerizing process therein. In such a polymerization process, a so-called multi-stage polymerization method is preferably used so that the polymerization reaction is carried out in a divided manner with multiple stages so as to prepare composite resin fine particles each of which is formed by resins having different molecular weight distributions with a molecular-weight gradient being formed toward the surface of the particle.

The following description will discuss the multi-stage polymerization method. When a multi-stage polymerization method (manufacturing method of composite resin fine particles obtained through the multi-stage polymerization method) is used, the manufacturing method of the toner of the present invention is preferably constituted by the following steps:

The multi-stage polymerization processes are carried out in a polymerization method which is used for expanding the molecular weight distribution of resin particles so as to prepare a toner capable of preventing the occurrence of offsets. In other words, in order to form phases having different molecular-weight distributions in each resin particle, the polymerization reaction is carried out in a divided manner with multiple stages; thus, the processes are intended in such a manner that each of the resulting resin particles is allowed to have a molecular weight gradient from the center of the particle toward the surface layer. For example, in this method, after a resin-particle dispersion solution having a high molecular weight has been first obtained, a polymerizable monomer and a chain transfer agent are newly added thereto so that a surface layer having a low molecular weight is formed. In the present invention, from the viewpoints of stability in production and breaking strength in toners, a multi-stage polymerization method with not less than three polymerization stages is preferably used. The following description will discuss two-stage polymerization method and three-stage polymerization process, which are typical examples of the multi-stage polymerization process. In the toner that is obtained through the multi-stage polymerization process of this type, the molecular weight is preferably made smaller from the center toward the surface layer from the viewpoint of breaking strength.

In the toner formed by toner particles obtained through the three-stage polymerization method, the wax is contained in only an intermediate layer made from an intermediate-molecular-weight resin so that the wax is finely dispersed uniformly; thus, the resulting toner is allowed to have sufficient durability, and preferably used as a non-magnetic mono-component developer. The three-stage polymerization method is more specifically explained as follows: First, a dispersion solution of resin particles (H), obtained through a polymerization process (first stage polymerization) that is carried out in a conventional method, is added to an aqueous medium (aqueous solution of surfactant), and after a monomer solution, prepared by dissolving a wax in a polymerizable monomer (m), has been dispersed the aqueous medium, this system is subjected to a polymerization process (second-stage polymerization), thereby preparing a dispersion solution of composite resin particles [high-molecular-weight resin (H)—intermediate-molecular-weight resin (M)] each of which is prepared by forming a coat layer (M) (intermediate layer) made from a resin containing the wax (polymer derived from the polymerizable monomer (m)) on the surface of each resin particle (H) (core particle). Next, to the resulting dispersion solution of the composite resin particles are added a polymerization initiator and a polymerizable monomer (L) used for obtaining the low-molecular-weight resin, and this is subjected to a polymerization process (third-stage polymerization) with a polymerizable monomer (1) in the presence of the composite resin particles so that a coat layer (L), made from a low-molecular-weight resin (polymer derived from a polymerizable monomer (1)), is formed on the surface of each of the composite resin particles. In this manner, composite resin particles, each constituted by a center portion (core) formed by the high-molecular-weight resin and the intermediate layer containing the wax and an outer layer (shell) made from the low-molecular-weight resin, are manufactured.

(4) First Salting-Out/Fusion-Adhering Processes

In the first salting-out/fusing-adhering processes, a dispersion solution of colorant particles is added to the dispersion solution of the resin particles A obtained by the above-mentioned polymerization process so that the resin particles A and the colorant particles are subjected to salting-out/fusing-adhering processes to obtain core particles.

The salting-out/fusion-adhering method includes processes in which: a salting-out agent, made from an alkali metal salt and/or an alkali earth metal salt and the like, is added to water containing resin particles and colorant particles as a coagulant having not less than a critical aggregating concentration, and this is then heated to not less than the glass transition point of the above-mentioned resin particles so that the salting-out process is allowed to proceed, as well as carrying out the fusion-adhering process. In these processes, an organic solvent, which is infinitely dissolved in water, may be added thereto. In the salting-out/fusion-adhering processes, "aqueous medium" refers to a solution having water as its main component (not less than 50% by weight). With respect to components other than water, organic solvents soluble to water are listed, and examples thereof include methanol, ethanol, isopropanol, butanol, acetone, methylethyl ketone and tetrahydrofran. Among these, alcohol based organic solvents, such as methanol, ethanol, isopropanol and butanol, which do not dissolve the resin, are preferably used.

The colorant particles to be used in the salting-out/fusion-adhering processes are prepared by dispersing a colorant in an aqueous medium. The dispersing process of the colorant is carried out in a state in which the surfactant concentration is set to not less than a critical micelle concentration (CMC) in water.

With respect to the dispersing machine to be used for the dispersion process of the colorant, although not particularly limited, examples thereof include pressure dispersing machines, such as a stirring apparatus "Clearmix", an ultrasonic dispersing machine, a mechanical homogenizer, a Manton-Gourin Homogenizer and a pressure homogenizer, and media-type dispersing machines, such as a sand grinder, a Gettman mill and a Diamond Fine Mill. With respect to the surfactant to be used, the same surfactants as those described earlier may be used.

Here, the colorant (particles) may be subjected to a surface-modifying treatment. In the surface-modifying method of the colorant, a colorant is dispersed in a solvent, and a surface-modifying agent is added to the dispersion solution, and this system is heated so as to undergo a reaction. After the completion of the reaction, the colorant agent is filtered and separated, and after having been washed with the same solvent and filtered repeatedly, the resulting matter is dried to obtain a colorant (pigment) that has been treated by the surface-modifying agent.

With respect to the alkali metal salt and alkali earth metal salt serving as the salting-out agent, examples thereof include alkali metals such as lithium, potassium and sodium. Examples thereof also include alkali earth metals such as magnesium, calcium, strontium and barium, and preferably potassium, sodium, magnesium, calcium and barium can be used. With respect to the salt to be formed, examples thereof include chloride, bromide, iodine, carbonate and sulfate.

Examples of the organic solvent that is infinitely dissolved in water include: methanol, ethanol, 1-propanol, 2-propanol, ethylene glycol, glycerin and acetone, and alcohols, such as methanol, ethanol, 1-propanol and 2-propanol, having not more than 3 carbon atoms, are preferably used, and 2-propanol is more preferably used.

In the salting-out/fusion-adhering processes, it is preferable to make the time during which the solution is left after the addition of the salting-out agent (time until the start of heating) as short as possible. In other words, after the addition of the salting-out agent, the heating process of the dispersion solution of the resin particles and the colorant particles is started as soon as possible to heat the dispersion solution to not less than the glass transition temperature of the resin particles. Although not sufficiently clarified, the reason for this is that, depending on the stand-still time after the salting-out, the aggregated state of particles is fluctuated to cause problems of instability in the particle-size distribution and of fluctuations in the surface property of the fused toners.

The time up to the start of the heating process (the stand-still time) is normally set within 30 minutes, preferably within 10 minutes.

Here, with respect to the temperature at which the salting-out agent is added, although not particularly limited, it is preferably set to not more than the glass transition temperature of the resin particles. In the salting-out/fusing-adhering processes, it is necessary to carry out a temperature-raising process quickly, and the temperature-rise rate is preferably set to not less than 1° C./minute. Although not particularly limited, the upper-limit of the temperature-rise rate is preferably set to not more than 15° C./minute from the viewpoint of suppressing the generation of bulky colored particles due to quick progresses of the salting-out/fusion-adhering processes.

After the dispersion solution of the resin particles and the colorant particles has reached a temperature of not less than the glass-transition temperature, it is important to maintain the temperature of the dispersion solution at this level for a predetermined time so that the salting-out/fusion-adhering processes are continued. Thus, the growth (aggregation of the resin particles and the colorant particles) of the colored particles (toner particles) and the fusion-adhering process (elimination of interface between particles) are effectively carried out so that the durability of the resulting toner can be improved. Here, after the stop of the growth of the associated colored particles, a heating process is carried out so as to continue the fusion-adhering process.

(5) Second Salting-Out/Fusion-Adhering Processes

The resin particles B and the core particles prepared in the first salting-out/fusion-adhering processes are further subjected to salting-out/fusion-adhering processes. More specifically, the same processes as the first salting-out/fusion-adhering processes are carried out except that the resin particles B are used in place of the resin particles A with the core particles being used in place of the colorant particles.

(6) Filtering/Washing Processes

In these filtering-washing processes, a filtering process for filtering and separating the colored particles from the dispersion solution of the toner particles obtained from the above-mentioned processes and a washing process for removing adhering matters such as the surfactant and the salting-out agent from the colored particles (cake-shaped aggregate) that have been filtered and separated are carried out. Here, with respect to the filtering treatment method, not particularly limited, a centrifugal separation method, a reduced-pressure filtering method using a nutshe or the like, a filtering method using a filter press and the like may be used.

(7) Drying Process

In this process, the colored particles (toner particles) that have been washed are dried. In the drying process, a drying apparatus, such as a spray dryer, a vacuum freeze drying machine and a reduced-pressure drying machine, is usable, and a stationary rack dryer, a moving rack dryer, a fluid bed dryer, a rotary dryer and a stirring dryer are preferably used. The moisture content of the colored particles (toner particles) after drying treatment is preferably not more than 5%, more preferably not more than 2%, by weight.

Here, when the colored particles that have been dried are aggregated through a weak interparticle attracting force, the aggregate may be pulverized. In this case, with respect to the pulverizing device, a mechanical pulverizing device, such as a Jet Mill, a Henschel mixer, a coffee mill and a food processor, may be used.

(8) External Additive Agent Adding Process

In this process, an external additive agent is added to the colored particles (toner particles) that have been dried. With respect to the device used for adding the external additive agent, various known mixing devices, such as a tabular mixer, a Henschel mixer, a Nauta mixer and a V-type mixer, may be used.

In addition to the colorant and wax, various materials that impart various functions may be added to the toner particles of the present invention. Specific examples of these include a charge-controlling agent and the like. These components are added thereto through various methods such as a method in which these are simultaneously added thereto in the above-mentioned salting-out/fusion-adhering processes together with the resin particles and the colorant particles to be contained in the toner and a method in which these are directly added to the resin particles. With respect to the charge-controlling agent also, various known agents, which can be dispersed in water, may be used. Specific examples thereof include Nigrosine dyes, metal salts of naphthenic acid or higher fatty acid, alkoxylated amine, quaternary ammonium salt compounds, azo-based metal complex, metal salts of salicylic acid or metal complexes thereof.

<Outline of Toner Particles>

(Toner Particle Size)

The toner particle size of the present invention is preferably from 3 to 9 μm, more preferably from 3 to 8 μm. This particle size can be controlled by adjusting the concentration of the coagulant (salting-out agent), the added amount of the organic solvent, the fusing time and the composition of the polymer, in a toner manufacturing method, which will be described later in detail.

The volume-average particle size of the toner is measured by a Coulter Counter TA-II or a Coulter Multisizer II (made by Beckman Coulter, Inc.). In the present invention, the Coulter Multisizer II is used, with an interface used for outputting the grain size distribution (made by Beckman Counter, Inc.) and a personal computer being connected thereto. With the aperture of the Coulter Multisizer II being set to 50 μm, the volume distribution of the toner having a particle size of not less than 0.99 μm (for example, 2 to 40 μm) was measured, and the grain-size distribution and the average particle size were calculated.

[Measuring Conditions]

(1) Aperture: 50 μm (2) Sample preparation method: To an electrolytic solution [ISOTON-II-pc (made by Beckman Counter, Inc.)] (50 to 100 ml) was added a predetermined amount of a surfactant (neutral detergent) and stirred, and to this further added 10 to 20 mg of a test sample. The sample was prepared by subjecting this system to a dispersion treatment for one minute by using an ultrasonic dispersing machine. The toner of the present invention is preferably designed so that the rate of the toner particles of not more than 3 μm is preferably set to not more than 20 number %; further, more preferably the rate of the toner particles of not more than 2 μm is set to not more than 10 number %.

(Shape of Toner Particles)

With respect to the toner shape of the present invention, an average value of the degree of roundness (an average value of degree of roundness indicated by the following expression) is preferably from 0.930 to 0.990, more preferably from 0.950 to 0.980.

Degree of roundness=(circumferential length of a circle obtained based on the diameter equivalent to a circle)/(circumferential length of the projected toner image)

When the degree of roundness is higher than this range, the cleaning property in processes using a photosensitive member and a transferring belt seriously deteriorates causing problems, and when the degree of roundness is lower than this range, the toner tends to have irregular shapes, causing degradation in anti-stress property of regulating units in developing processes.

The degree of roundness preferably has a sharp distribution, and the standard deviation of the degree of roundness is preferably not more than 0.10, and the CV value obtained by the formula shown below is preferably less than 20%, more preferably less than 10%.

*CV* value=(standard deviation of degree of roundness/average degree of roundness)×100

By adjusting the standard deviation of the degree of roundness to not more than 0.10, it is possible to prepare toner particles having a uniform shape and also to minimize the difference in anti-stress property and cleaning property between toner particles. By adjusting the CV value to less than 20%, it is possible to narrow the size distribution in the same manner and to more desirably exhibit the above-mentioned effects. Methods for measuring the average degree of roundness are not limited. For example, toner particles are enlarged by a factor of 500 employing an electron microscope and photographed. Subsequently, the degree of roundness of at least 500 toner particles is determined by using an image analysis apparatus. The arithmetic average is then obtained so that an average degree of roundness can be calculated. As a simple measurement method, it is possible to carry out measurements by using an FPIA-1000 (made by TOA MEDICAL ELECTRONICS CO., LTD.).

(Toner Thermal Characteristics)

The softening point of the toner of the present invention is set in a range from 70 to 150° C., preferably from 80 to 130° C., more preferably from 85 to 120° C. The softening point lower than this range is not preferable since it causes degradation in shelf life and tacking property immediately after a fixing process during continuous copying operations. The softening point higher than this range is not preferable since it makes the fixing temperature too high.

(Measuring Method for Softening Point (Tm) of Resin or Toner)

A sample to be measured (resin or toner) (1.0 g) was weighed, and a flow tester (CFT-500: made by Shimadzu Corp) was used in which: measurements were made under conditions of the application of a die having a size of h 1.0 mm×ϕ1.0 mm, a temperature-rise rate of 3.0° C./min, a pre-heating time of 180 seconds, a load of 30 kg and a measuring temperature range of 60 to 140° C., and the temperature at the time of the ½ flow of the above-mentioned sample was defined as the softening point (Tm).

EXAMPLES

The following description will discuss examples of the present invention in more detail; however, the present invention is not intended to be limited thereby. Here, in the following description, the term "parts" refers to "parts by weight".

<Synthesis of Wax>

The following Tables 1 and 2 show the composition of each of waxes used in the toner of the present invention and physical property values of each of core-shell type toners using the wax.

Wax A was synthesized through the following method.

To a four-neck flask equipped with a thermometer, a nitrogen introducing device, a stirring device and a cooling pipe were added 400 g (1.5 mol) of stearyl alcohol serving as an alcohol component and 430 g (1.5 mol) of stearic acid serving as a carboxylic acid component, and this was allowed to react at normal pressure for 15 hours under a nitrogen gas flow while distilling the reaction water off at 220° C. The amount of the resulting esterified coarse product was 800 g. To 800 g of the esterified coarse product were added 200 g of cyclohexane and 40 g of isopropanol, and to this was further added a 8% aqueous solution of sodium hydroxide the amount of which corresponds to 1.5 times the equivalent of the acid value of the esterified coarse product, and stirred for 30 minutes at 70° C. Thereafter, this was allowed to stand still for 30 minutes and the water-layer portion was separated and removed. Washing processes were repeated four times until the pH of the waste water had become neutral. With respect to the remaining ester layer, the solvent was distilled off at 180° C. under reduced pressure of 1 kPa, and filtered to obtain an ester wax having a melting point of 60° C.

With respect to waxes B to E, those synthesized under conditions of Table 1 were used.

TABLE 1

| | Acid component | | Acid component | | Esterification | Hydrocarbon solvent | | Alcohol solvent | | Alkaline solution | Melting |
|---|---|---|---|---|---|---|---|---|---|---|---|
| | weight | mole | weight | mole | (weight (g)) | weight | parts by weight | weight | parts by weight | (weight (g)) | point ° C. |
| Wax A | Stearic Acid 430 g | 1.5 mole | Stearyl Alcohol 400 g | 1.5 mole | 800 | Cyclohexane 200 g | 25 | Isopropanol 40 g | 5 | 8% NaOH solution 60 g | 60° C. |
| Wax B | Behenic Acid 450 g | 1.3 mole | Behenyl Alcohol 400 g | 1.3 mole | 830 | Toluene 170 g | 20 | Isopropanol 30 g | 4 | 10% NaOH solution 110 g | 73° C. |
| Wax C | Palmitin Acid 900 g | 3.5 mole | Glycerine 100 g | 1.1 mole | 950 | Cyclohexane 240 g | 25 | n-propanol 80 g | 10 | 8% NaOH solution 200 g | 67° C. |
| Wax D | Stearic Acid 900 g | 3.2 mole | Pentaerythritol 100 g | 0.7 mole | 950 | Xylene 300 g | 30 | Ethanol 90 g | 10 | 10% KOH solution 170 g | 79° C. |
| Wax E | Behenic Acid 1050 g | 3.1 mole | Pentaerythritol 100 g | 0.7 mole | 1000 | Xylene 160 g | 15 | Ethanol 40 g | 4 | 10% NaOH solution 120 g | 85° C. |

TABLE 2

| | Physical properties of toner | | | | | | | | |
|---|---|---|---|---|---|---|---|---|---|
| | Core No | Shell No | Core Wax/ Melting point | Shell Wax/ Melting point | Core Wax amount | Shell Wax amount | Core Wax diameter | Shell Wax diameter | Shell weight ratio |
| Ex. 1 | I | ① | A/60 | E/85 | 17.5% | 12.5% | 0.4μ | 0.7μ | 10% |
| Ex. 2 | II | ① | A/60 | E/85 | 20.0% | 12.5% | 0.5μ | 0.7μ | 10% |
| Ex. 3 | III | ① | A/60 | E/85 | 15.0% | 12.5% | 0.35μ | 0.7μ | 10% |
| Ex. 4 | I | ② | A/60 | E/85 | 17.5% | 15.0% | 0.4μ | 0.8μ | 10% |
| Ex. 5 | I | ③ | A/60 | E/85 | 17.5% | 10.0% | 0.4μ | 0.6μ | 10% |
| Ex. 6 | IV | ① | B/73 | E/85 | 17.5% | 12.5% | 0.45μ | 0.7μ | 10% |
| Ex. 7 | V | ① | C/67 | E/85 | 17.5% | 12.5% | 0.6μ | 0.7μ | 10% |
| Ex. 8 | I | ④ | A/60 | D/79 | 17.5% | 12.5% | 0.4μ | 0.7μ | 10% |
| Ex. 9 | I | ① | A/60 | E/85 | 17.5% | 12.5% | 0.4μ | 0.7μ | 5% |
| Ex. 10 | I | ① | A/60 | E/85 | 17.5% | 12.5% | 0.4μ | 0.7μ | 15% |

TABLE 2-continued

| | Physical properties of toner | | | | | | | | |
|---|---|---|---|---|---|---|---|---|---|
| | Core No | Shell No | Core Wax/ Melting point | Shell Wax/ Melting point | Core Wax amount | Shell Wax amount | Core Wax diameter | Shell Wax diameter | Shell weight ratio |
| Com. Ex. 1 | VI | ① | A/60 | E/85 | 30.0% | 12.5% | 0.9μ | 0.7μ | 10% |
| Com. Ex. 2 | VII | ⑥ | A/60 | E/85 | 17.5% | 20.0% | 0.4μ | 1.0μ | 10% |
| Com. Ex. 3 | I | ⑦ | A/60 | E/85 | 17.5% | 30.0% | 0.4μ | 1.2μ | 10% |
| Com. Ex. 4 | I | ⑧ | A/60 | E/85 | 17.5% | 2.5% | 0.4μ | 0.4μ | 10% |
| Com. Ex. 5 | I | ⑨ | A/60 | A/60 | 17.5% | 12.5% | 0.4μ | 0.5μ | 10% |
| Com. Ex. 6 | VIII | ⓫ | E/85 | A/60 | 17.5% | 12.5% | 0.8μ | 0.5μ | 10% |
| Com. Ex. 7 | I | — | A/60 | — | 17.5% | — | 0.4μ | — | none |

Example 1

<Preparation of Resin Particles A>

<<Colorant Dispersion Solution>>

| (Cyan colorant dispersion solution C1) | |
|---|---|
| Pigment C.I. Pigment Blue 15:3 | 50 parts |
| Sodium dodecyl sulfate | 10 parts |
| Ion exchanged water | 200 parts |

The mixture of the above-mentioned components was dispersed by using a sand grinder mill to obtain a pigment fine particle dispersion solution having a volume-average particle size ($D_{50}$) of 170 nm.

(Magenta Colorant Dispersion Solution M1)

Under all the same conditions as those of the preparation of the above-mentioned cyan colorant dispersion solution C1 except that the pigment was changed to C. I. Pigment Red 122, a magenta colorant dispersion solution M1 was prepared, thereby obtaining a pigment fine particle dispersion solution having a volume-average particle size ($D_{50}$) of 180 nm.

(Yellow Colorant Dispersion Solution Y1)

Under all the same conditions as those of the preparation of the above-mentioned cyan colorant dispersion solution C1 except that the pigment was changed to C. I. Pigment Yellow 74, a yellow colorant dispersion solution Y1 was prepared, thereby obtaining a pigment fine particle dispersion solution having a volume-average particle size ($D_{50}$) of 150 nm.

(Black Colorant Dispersion Solution K1)

Under all the same conditions as those of the preparation of the above-mentioned cyan colorant dispersion solution C1 except that the pigment is changed to carbon black (Mogul L; made by Cabot Corporation), a black colorant dispersion solution K1 was prepared, thereby obtaining a pigment fine particle dispersion solution having a volume-average particle size ($D_{50}$) of 160 nm.

<<Preparation of Latex>>

(Preparation of Latex 1HML)

| (Dispersion medium 1) | |
|---|---|
| Sodium dodecyl sulfate | 4.05 g |
| Ion exchanged water | 2,500.00 g |

(1) Preparation of core particles (First-stage polymerization)

To a separable flask (5,000 ml) equipped with a stirring device, a thermometer, a cooling pipe and a nitrogen introducing device was loaded the above-mentioned dispersion medium 1, and this was heated to 80° C. in the flask, while being stirred at a stirring speed of 230 rpm under a nitrogen gas flow.

| (Monomer solution 1) | |
|---|---|
| Styrene | 568.00 g |
| n-butyl acrylate | 164.00 g |
| Methacrylic acid | 68.00 g |
| n-octyl mercaptan | 16.51 g |

To this active agent solution was added an initiator solution prepared by dissolving 9.62 g of a polymerization initiator (potassium persulfate) in 200 g of ion exchanged water, and to this was dripped the above-mentioned monomer solution in 90 minutes, and this system was heated at 80° C. for 2 hours, and to this was further added an initiator solution prepared by dissolving 3.85 g of a polymerization initiator (potassium -persulfate) in 100 g of ion exchanged water, and this was heated and stirred for 2 hours to carry out a polymerization process (first-stage polymerization); thus, a latex was prepared. This is referred to as "latex (1H)". The weight-average particle size of the latex (1H) was 62 nm.

When the latex (1H) was dried and solidified, the resulting matter had a THF insoluble component of 98%, and no glass transition point due to DSC was observed at not less than 30° C.

(2) Formation of Intermediate Layer (Second-Stage Polymerization)

| (Monomer solution 2) | |
|---|---|
| Styrene | 123.81 g |
| n-butyl acrylate | 39.51 g |
| Methacrylic acid | 12.29 g |
| n-octyl mercaptan | 0.72 g |
| Wax-A | 138.80 g |

The above-mentioned monomer solution 2 was loaded into a flask equipped with a stirring device, and heated to 80° C. and dissolved so that a monomer solution was prepared.

| (Dispersion medium 2) | |
|---|---|
| $C_{10}H_{21}(OCH_2CH_2)_2OSO_3Na$ | 0.60 g |
| Ion exchanged water | 2,700.00 g |

Here, the above-mentioned dispersion medium 2 was heated to 98° C., and after 32 g of the above-mentioned latex (1H) as expressed in terms of solid component equivalent that served as the dispersion medium of nucleus particles had been added to this dispersion medium, the monomer solution 2 was mixed and dispersed therein for 8 hours by using a mechanical dispersing machine "CLEARMIX" having a circulation path (made by M Technique) to prepare a dispersion solution (emulsion solution) containing emulsified particles (oil droplets).

Next, to this dispersion solution (emulsion solution) was added an initiator solution prepared by dissolving 6.12 g of a polymerization initiator (potassium persulfate) in 250 ml of ion exchanged water, and this system was heated while being stirred at 82° C. for 12 hours to carry out a polymerization process (second-stage polymerization) to prepare a latex (dispersion solution of resin particles, each having a structure in which the surface of a latex (latex (1H)) particle covered with a coat film). This is referred to as "latex (1HM)".

(3) Formation of Outer Layer (Third-Stage Polymerization)

| (Monomer solution 3) | |
|---|---|
| Styrene | 358.26 g |
| n-butyl acrylate | 89.57 g |
| n-octyl mercaptan | 6.05 g |

To the latex (1HM) obtained as described above was added an initiator solution prepared by dissolving 8.4 g of a polymerization initiator (KPS) in 350 ml of ion exchanged water, and to this was dripped the above-mentioned monomer solution 3 in one hour at 82° C. After the dripping process, this was heated and stirred for 2 hours to carry out a polymerization process (third-stage polymerization), and then cooled to 28° C. to prepare a latex (dispersion solution of composite resin particles, each of which has a center portion made from the latex (1H), an intermediate layer made from the second-stage polymerization resin and an outer layer made from the third-stage polymerization resin, with WEP-5 being contained in the second-stage polymerization resin). This is referred to as "latex (1HML)".

The resin fine particles constituting this latex (1HML) contained a THF insoluble component of 5.2%, while a THF soluble component had a peak molecular weight at 18,000, and the weight-average particle size of the resin fine particles was 130 nm.

<Preparation of Resin Particles B>

(1) Preparation of Particles (First-Stage Polymerization)

To a separable flask (5,000 ml) equipped with a stirring device, a thermosensor, a cooling pipe and a nitrogen introducing device was loaded a surfactant solution (aqueous medium) prepared by dissolving 7.08 g of an anionic surfactant shown below in 3,010 g of ion exchanged water, and this was heated to 80° C. in the flask, while being stirred at a stirring speed of 230 rpm under a nitrogen gas flow.

To a solution containing an anionic surfactant $C_{10}H_{21}(OCH_2CH_2)_2OSO_3Na$ was added an initiator solution prepared by dissolving 9.2 g of a polymerization initiator (potassium persulfate) in 200 g of ion exchanged water, and after this had been heated to 80° C., to this was dripped a monomer mixed solution composed of 70.1 g of styrene, 19.9 g of n-butyl acrylate and 10.9 g of methacrylic acid in one hour, and this system was heated at 80° C. for 2 hours, while being stirred, to carry out a polymerization process (first-stage polymerization); thus, a latex (dispersion solution of resin particles made from a high-molecular-weight resin) was prepared. This is referred to as "latex (A)".

(2) Formation of Intermediate Layer (Second-Stage Polymerization)

In a flask equipped with a stirring device, to a monomer mixed solution composed of 105.6 g of styrene, 30.0 g of n-butyl acrylate, 6.2 g of methacrylic acid and 5.6 g of n-octyl-3-mercaptopropionic acid ester was added 82.5 g of Wax-E as a wax, and this was heated to 90° C. to be dissolved; thus, a monomer solution was prepared.

Here, a surfactant solution, prepared by dissolving 1.6 g of the above-mentioned anionic surfactant in 2,700 ml of ion exchanged water, was heated to 98° C., and after 28 g of the above-mentioned latex A as expressed in terms of solid component equivalent that served as the dispersion medium of nucleus particles had been added to this surfactant solution, the monomer solution containing the wax was mixed and dispersed therein for 8 hours by using a mechanical dispersing machine "CLEARMIX" having a circulation path (made by M Technique) to prepare a dispersion solution (emulsion solution) containing emulsified particles (oil droplets).

Next, to this dispersion solution (emulsion solution) were added an initiator solution prepared by dissolving 5.1 g of a polymerization initiator (KPS) in 240 ml of ion exchanged water and 750 ml of ion exchanged water, and this system was heated while being stirred at 98° C. for 12 hours to carry out a polymerization process (second stage polymerization) to prepare a latex (dispersion solution of composite resin particles, each having a structure in which the surface of a resin particle made from a high-molecular weight resin is coated with an intermediate-molecular weight resin). This is referred to as "latex (B)".

(3) Formation of Outer Layer (Third-Stage Polymerization)

To the latex (B) obtained as described above was added an initiator solution prepared by dissolving 7.4 g of a polymerization initiator (KPS) in 200 ml of ion exchanged water, and to this was dripped a monomer mixed solution composed of 300 g of styrene, 95 g of n-butyl acrylate, 15.3 g of methacrylic acid and 10.4 g of n-octyl-3-mercaptopropionic acid ester in one hour at 80° C. After the dripping process, this was heated and stirred for 2 hours to carry out a polymerization process (third-stage polymerization), and then cooled to 28° C. to prepare a latex (dispersion solution of composite resin particles, each of which has a center portion made from a high-molecular-weight resin, an intermediate layer made from an intermediate-molecular-weight resin and an outer layer made from a low-molecular-weight resin, with a polyethylene wax being contained in the intermediate layer). This is referred to as "latex (C)". The composite resin particles constituting this latex (C) had peak molecular weights at 138,000, 80,000 and 13,000, and the weight-average particle size of the resin fine particles was 120 nm.

<Preparation of Core Particles>

To a reaction container (four-neck flask) equipped with a temperature sensor, a cooling tube, a nitrogen gas directing device and a stirring device were charged and stirred 420.0 g of the latex (1HML) (as expressed in terms of solid component equivalent), 900 g of ion exchange water and 150 g of the cyan colorant dispersion solution Cl. After the temperature inside the container had been adjusted to 30° C., a 5-N sodium hydroxide aqueous solution was added to this solution to adjust the pH to 8 to 10.0.

Next, a solution, prepared by dissolving 12.1 g of magnesium chloride 6 hydrate in 1,000 ml of ion exchange water, was dripped therein at 30° C. in 10 minutes, while being stirred. After having been left for 3 minutes, this was heated to 84° C. to form associated particles. In this state, the particle size of the associated particles was measured by "Coulter Counter TA-II", and at the time when the number-average particle size was set to 6.1 μm, an aqueous solution, prepared by dissolving 80.4 g of sodium chloride in 1,000 ml of ion exchange water, was added thereto to stop the growth of the particles so that core particles 1 were obtained.

<Salting-Out/Fusion-Adhering Process Between Core Particles and Resin Particles B>

To the colored particles 1 obtained as described earlier was added each of dispersion solutions of shell-use resin particles while adjusting the weight ratio (S/(S+K)×100) % between the weight (S) of the shell-use resin particles and the weight (K) of the colored particles to each of values shown in Table 2, and this was heated and stirred at a solution temperature of 95° C. so as to be matured; thus, the fusion-adhering process of the particles and the phase separation process of the crystalline substances were continuously carried out (maturing process). In this state, the shape of the associated particles was measured by using a "FPIA-2000", and at the time when the shape coefficient had reached 0.970, this was cooled to 30° C., and the pH was adjusted to 2.0 by adding hydrochloric acid thereto, and after having been stirred for 12 hours, the stirring process was stopped. The resulting associated particles were filtered, and repeatedly washed with ion exchanged water at 45° C., and then dried by a hot air flow at 40° C. so that colored particles 1 were obtained. The number-average particle size and the shape coefficient of the colored particles were again measured and found to be 6.0 μm and 0.972, respectively.

<Addition of External Additives>

Hydrophobic silica (number-average primary particle size=12 nm, degree of hydrophobicity=68) was added thereto at a rate so as to reach 1.0% by weight and hydrophobic titanium oxide (number-average primary particles size=20 nm, degree of hydrophobicity=63) was also added thereto at a rate so as to reach 1.2% by weight, and this was mixed by a Henschel mixer to produce toner 1. Here, the shape and the particle size of the toner were not changed by the addition of the hydrophobic silica and hydrophobic titanium oxide.

Examples 2 to 5

The same processes as those of Example 1 were carried out except that the amount of wax and the dispersion diameter of wax in the core layer and/or the shell layer were changed as shown in Table 2 to produce toner particles.

Examples 6 to 8

The same processes as those of Example 1 were carried out except that the kinds of wax and the dispersion diameter of wax were changed as shown in Table 2 to produce toner particles.

Examples 9 and 10

The same processes as those of Example 1 were carried out except that the weight ratio of the shell layer was changed as shown in Table 2 to produce toner particles.

Comparative Examples 1 to 4

The same processes as those of Example 1 were carried out except that the amount of wax and the dispersion diameter of wax in the core layer were changed as shown in Table 2 to produce toner particles.

Comparative Example 5

The same processes as those of Example 1 were carried out except that wax A was used in the core layer and the shell layer to produce toner particles.

Comparative Example 6

The same processes as those of Example 1 were carried out except that wax E was used in the core layer, with wax A being used in the shell layer, to produce toner particles.

Comparative Example 7

The same processes as those of Example 1 were carried out except that wax A was used only in the core layer to produce toner particles.

<Evaluation Contents and Evaluation Method>

The following description will discuss evaluation processes carried out to confirm the effects of the toner of the present invention; however, the present invention is not intended to be limited by these evaluation processes.

<<Evaluation of Endurance>>

By using a developing device of a magicolor2300DL (made by Minolta QMS Co., Ltd.), evaluation processes were carried out.

In the evaluation processes, endurance test processes of 2,000 sheets of white paper were carried out by using a color laser printer (magicolor2300DL made by Minolta Co., Ltd.) under each of environmental conditions (HH/NN/LL), and the toner to be evaluated was then taken out. The toner particles were observed under a reflection-type electronic microscope at a magnification of ×1,000, five times with the viewing field being changed; thus, the average number of broken toner particles was found in 500 toner particles. The evaluation was made based upon the following criteria.

○: No broken toner particles were found, causing no problems in practical use.

Δ: Although one or two broken toner particles were present; however, no problems were raised in practical use.

×: Not less than 10 broken toner particles were present, causing problems in practical use.

<<Evaluation of Fixing Properties>>

(Evaluation Fixing Device)

A fixing device of a magicolor2300DL (made by Minolta QMS Co., Ltd.) was modified so as to desirably change its temperature control, and used for the evaluation.

(Offset)

While the temperature of the fixing roller was changed, a solid image having superposed three layers with a total amount of adhesion of 15 g/m$^2$ was outputted on the low-temperature side, and a mono-color gradation image with a total amount of adhesion of 0 to 5.0 g/m$^2$ was outputted for each color on the high-temperature side; thus, each image on paper after having passed through the fixing roller was observed. In each of the images, evaluation was made based upon a fixing temperature width in which neither low-temperature offset nor high-temperature offset occurred. With respect to the paper, CF paper (basis weight 80 g/m$^2$), which is standard paper for use in CF900, was used. Images having even a slight offset were evaluated as "no good".

○: The fixing temperature width was wider than 40° C.

Δ: The fixing temperature width was from 30° C. to 40° C.

×: The fixing temperature width was less than 30° C.

(Fixing Separation)

In the above-mentioned offset evaluation, the roller temperature was set to +15° C. from the lower limit value of the temperature width causing no offset, and an entire-surface solid image of three colors with a total amount of adhesion of 15 g/m$^2$ was outputted on MT paper (basis weight 64 g/m$^2$). The above-mentioned paper had image losses on the upper and lower ends and the right and left ends, each having a length of 5 mm. Toners that allowed the paper to pass without causing any wrapping onto the fixing roller were evaluated as "○", and toners that failed to allow the paper to pass due to wrapping onto the fixing roller were evaluated as "×".

(Low-Temperature Fixing Property)

A copied image, fixed onto copy paper at 130° C. in the above-mentioned evaluation methods for the separating property/anti-offsetting property, was folded from the middle portion into two, and the separating property was visually observed.

○: No problems were caused in practical use.

Δ: Although slight separation occurred, no problems were caused in practical use.

×: Problems were caused in practical use.

(Gloss Irregularity)

A color copying machine, DiALTA Color CF3102 (made by Minolta QMS Co., Ltd.), was modified to a transfer simultaneous fixing device with an intermediate transfer belt and a belt fixing process, and the fixing temperature was set to +20° C. from the lower limit fixing temperature; then, after endurance printing processes of 10 k copies, a solid pattern having an amount of toner adhesion of 12.5±0.5 g/m$^2$ was outputted and the state of gloss irregularity was visually observed.

○: There was virtually no difference between the highest degree of gloss and the lowest degree of gloss.

Δ: There was a slight difference between the highest degree of gloss and the lowest degree of gloss; however, no problems were raised in practical use.

×: There was a clear difference between the highest degree of gloss and the lowest degree of gloss, causing problems in practical use.

<<Heat-Resistant Storing Property>>

Toner (20 g) was put into a glass bottle, and after having been left at a high temperature of 50° C. for 24 hours, the toner was visually observed.

○: There were no aggregated toner particles, causing no problem.

Δ: Soft aggregation was slightly observed, but easily crumbled, causing no problems in practical use.

×: Firmly aggregated clumps were observed, and hardly crumbled to cause serious problems in practical use.

<<Anti-Filming Property (Including BS Property)>>

With respect to a color laser printer, magicolor2300DL (made by Minolta QMS Co., Ltd.), conditions on the photosensitive member and the intermediate transferring member were visually observed respectively after the initial process under L/L (low-temperature/low-moisture environment), after the initial process under N/N and after continuous copying processes of 2,000 sheets (after endurance tests).

Here, the continuous copying processes were carried out under a condition of B/W ratio of 6% using a predetermined print pattern.

○: There were neither filming nor BS, causing no problems.

Δ: Filming and BS occurred in either of the members; however, no problem occurred on the image.

×: Filming and BS occurred and the resulting adverse effects were observed on the image.

Table 3 shows the results of the tests.

TABLE 3

| | Evaluation | | | | | | |
|---|---|---|---|---|---|---|---|
| | Fixing seperation | Offset | Low temperature fixing property | Gloss irregularity | Filming | Heat resistant | Endurance |
| Ex. 1 | ○ | ○ | ○ | ○ | ○ | ○ | ○ |
| Ex. 2 | ○ | Δ | ○ | ○ | ○ | Δ | Δ |
| Ex. 3 | ○ | ○ | Δ | ○ | ○ | Δ | Δ |
| Ex. 4 | ○ | ○ | ○ | ○ | Δ | Δ | ○ |
| Ex. 5 | ○ | Δ | ○ | ○ | ○ | ○ | ○ |
| Ex. 6 | ○ | ○ | Δ | ○ | ○ | ○ | ○ |
| Ex. 7 | ○ | ○ | Δ | Δ | Δ | Δ | Δ |
| Ex. 8 | ○ | ○ | ○ | ○ | ○ | Δ | ○ |

TABLE 3-continued

| | Evaluation | | | | | | |
|---|---|---|---|---|---|---|---|
| | Fixing seperation | Offset | Low temperature fixing property | Gloss irregularity | Filming | Heat resistant | Endurance |
| Ex. 9 | ○ | Δ | ○ | ○ | ○ | ○ | Δ |
| Ex. 10 | ○ | ○ | Δ | Δ | ○ | ○ | Δ |
| Com. Ex. 1 | X | X | X | ○ | X | X | X |
| Com. Ex. 2 | ○ | ○ | ○ | Δ | Δ | X | X |
| Com. Ex. 3 | ○ | ○ | ○ | X | X | X | X |
| Com. Ex. 4 | X | X | ○ | ○ | ○ | ○ | ○ |
| Com. Ex. 5 | X | X | ○ | X | X | X | X |
| Com. Ex. 6 | ○ | Δ | X | Δ | Δ | X | X |
| Com. Ex. 7 | X | X | ○ | ○ | X | X | X |

(Results)

As clearly indicated by the results shown in Table 3, in the actual machine tests, the melting point of the second wax of the shell layer is maintained higher than the melting point of the first wax of the core layer, the average dispersion diameter of the first wax is made smaller than the average dispersion diameter of the second wax, and the content of the first wax in the core layer is made greater than the content of the second wax in the shell layer; thus, it is confirmed that the toner of the present invention with this arrangement provides a low-temperature fixing property while maintaining superior toner properties.

What is claimed is:

1. A toner comprising: a core layer and a shell layer formed on the core layer, wherein the core layer and the shell layer respectively contain a first wax and a second wax; the second wax has a melting point that is higher than a melting point of the first wax; the first wax has an average dispersion diameter that is smaller than the average dispersion diameter of the second wax; the first wax has a content in the core layer that is greater than a content of the second wax in the shell layer; and the first wax has a content in a range of 10 to 30% by weight in the core layer and the second wax has a content in a range of 5 to 25% by weight in the shell layer.

2. The toner according to claim 1, wherein the first wax has an average dispersion diameter in a range of 0.3 to 0.8 μm and the second wax has an average dispersion diameter in a range of 0.5 to 1.0 μm.

3. The toner according to claim 1, wherein the first wax and the second wax are ester compounds.

4. The toner according to claim 3, wherein the first wax contains a straight-chain saturated monohydroxy alcohol as an alcohol component and the second wax contains a di- to hexa-valent polyhydroxy alcohol as an alcohol component.

5. The toner according to claim 1, wherein the second wax has a melting point that is higher than a melting point of the first wax by 5° C.

6. The toner according to claim 1, wherein each of the first wax and the second wax has a melting point that is not more than 100° C.

7. The toner according to claim 1, wherein the resin forming the core layer has a weight-average molecular weight in a range of 15,000 to 500,000.

8. The toner according to claim 1, wherein the resin forming the core layer comprises high-molecular-weight resin particles, intermediate-molecular-weight resin particles and low-molecular-weight resin particles, and the intermediate-molecular-weight resin particles have a weight-average molecular weight that is smaller than that of the high-molecular-weight resin particles, and greater than that of the low-molecular-weight resin particles.

9. The toner according to claim 8, wherein the high-molecular-weight resin particles have a weight-average molecular weight in a range of 160,000 to 500,000, and the low-molecular-weight resin particles have a weight-average molecular weight in a range of 15,000 to 20,000.

10. The toner according to claim 1, wherein the toner comprises toner particles each of which has the core layer and the shell layer, and the toner particles have a degree of roundness in a range from 0.930 to 0.990, with a standard deviation of the degree of roundness being set to not more than 0.10.

11. The toner according to claim 1, wherein the toner has a softening point in a range from 70 to 150° C.

12. A toner comprising:

a core layer that is formed by allowing at least first resin particles and a colorant to aggregate and fusion-adhere to one another; and a shell layer that is formed by allowing second resin particles to aggregate and fusion-adhere to the surface of the core layer, wherein the core layer and the shell layer respectively contain a first wax and a second wax; the second wax has a melting point that is higher than a melting point of the first wax; the first wax has an average dispersion diameter that is smaller than the average dispersion diameter of the second wax; the first wax has a content in the core layer that is greater than a content of the second wax in the shell; and the first wax has a content in a range of 10 to 30% by weight in the core layer and the second wax has a content in a range of 5 to 25% by weight in the shell layer.

13. The toner according to claim 12, wherein the first wax has an average dispersion diameter in a range of 0.3 to 0.8 μm and the second wax has an average dispersion diameter in a range of 0.5 to 1.0 μm.

14. The toner according to claim 12, wherein the first wax and the second wax are ester compounds, and the first wax contains a straight-chain saturated monohydroxy alcohol as an alcohol component and the second wax contains a di- to hexa-valent polyhydroxy alcohol as an alcohol component.

15. The toner according to claim 12, wherein the first wax and the second wax are ester compounds.

16. The toner according to claim 12, wherein the second wax has a melting point that is higher than a melting point of the first wax.

17. The toner according to claim 12, wherein the melting point of the second wax has a difference from the melting point of the first wax by not less than 5° C.

* * * * *